US005946740A

United States Patent [19]

Sorimachi

[11] Patent Number: 5,946,740

[45] **Date of Patent: *Sep. 7, 1999**

[54] HOLDER FOR OPENING/CLOSING APPARATUS FOR SEATS AND LIDS OF WESTERN-STYLED LAVATORY STOOLS

[75] Inventor: Akira Sorimachi, Kanagawa, Japan

[73] Assignee: Katoh Electrical Machinery Co., Ltd.

[ * ] Notice: This patent is subject to a terminal disclaimer.

[21] Appl. No.: 08/958,024

[22] Filed: Oct. 27, 1997

[30] Foreign Application Priority Data

Oct. 29, 1996 [JP] Japan ..... 8-286307

[51] Int. Cl.[6] ..... A47K 13/12

[52] U.S. Cl. ..... 4/236; 4/234; 4/246.1

[58] Field of Search ..... 4/236, 240, 234, 4/241, 246.1, 248, 237

[56] References Cited

U.S. PATENT DOCUMENTS 3,613,130 10/1971 Sansone ..... 4/240
5,724,683 3/1998 Sorimachi et al. ..... 4/248

FOREIGN PATENT DOCUMENTS

480534A1 4/1992 European Pat. Off. .
2702948 3/1993 France .

*Primary Examiner*—David J. Walczak
*Attorney, Agent, or Firm*—Notaro & Michalos P.C.

[57] ABSTRACT

According to the invention, in order to make opening/closing devices for seats and lids of Western-styled lavatory tools readily detachable from the stool, a holder for such opening/closing devices is composed of a cylindrical case open at both ends, structured so as to allow insertion and engagement of a pair of opening/closing devices, of which one works on the seat and the other on the lid, with one inserted from one of the two ends of the case and the other from the other end in a detachable manner; a pair of legs hanging from this case each having at its lower end an engaging piece given elasticity; and holder receptacles structured to be to be fitted into fitting holes provided in the lavatory stool to allow detachable insertion and engagement of the pair of legs as well in a freely detachable manner. In this configuration, said holder receptacles are composed in a bottomless cylindrical form having engaging projects at their lower end so that they can be contained and fixed in penetrating holes bored into the stool itself.

2 Claims, 5 Drawing Sheets

HOLDER FOR OPENING/CLOSING APPARATUS FOR SEATS AND LIDS OF WESTERN-STYLED LAVATORY STOOLS

BACKGROUND OF THE INVENTION

1. Field of the Invention

The present invention relates to a holder for use with an opening/closing device for seats and lids of Western-styled lavatory stools.

2. Description of the Prior Art

In order to stably hold the seat and/or the lid of a Western-styled lavatory stool when it is open and to prevent it from dropping abruptly when it is closed, various opening/closing devices, each consisting of independent right and left units with rotation control means to control the rotating torque of the seat and/or the lid, according to the prior art, are publicly known. These opening/closing devices are usually fitted to the stool with fitting bolts.

Whereas the fitting parts of an opening/closing device are susceptible to adherence of dust together with filthy water, which tends to emit foul smell and be unsanitary, and therefore should be cleaned from time to time, the aforementioned prior art devices require, every time they are to be cleaned, detachment of the right and left units separately, and this is not only troublesome but also imposes an annoying household chore on family ladies, who are often not mechanically minded.

Furthermore, if an existing opening/closing device without rotation control means is to be replaced by this opening/control device with rotation control means, the installing ease of the new device would facilitate the replacing work and, accordingly, extensive distribution of the new device.

SUMMARY OF THE INVENTION

An object of the present invention is to provide a holder for use with an opening/closing device for seats and lids of Western-styled lavatory stools so configured as to enable any person easily to install the device, together with the seat and/or the lid onto the stool itself, and to detach it from the stool.

In order to achieve the aforementioned object, according to the invention, there is provided a pair of opening/closing devices each working on a seat or a lid, to which it is linked in the axial direction with a fitting pin, the pair consisting of a case structured to allow insertion and engagement of one or the other of the opening/closing devices from each of the two ends thereof in a detachable manner; legs hanging from this case; and holder receptacles to be fitted to the stool to allow detachable insertion and engagement of the legs.

In this configuration, according to the invention, said holder receptacles may be composed in a bottomless cylindrical form so that they can be contained and fixed in penetrating holes bored into the stool itself.

DETAILED DESCRIPTION OF THE PREFERRED EMBODIMENT

Figure 1:
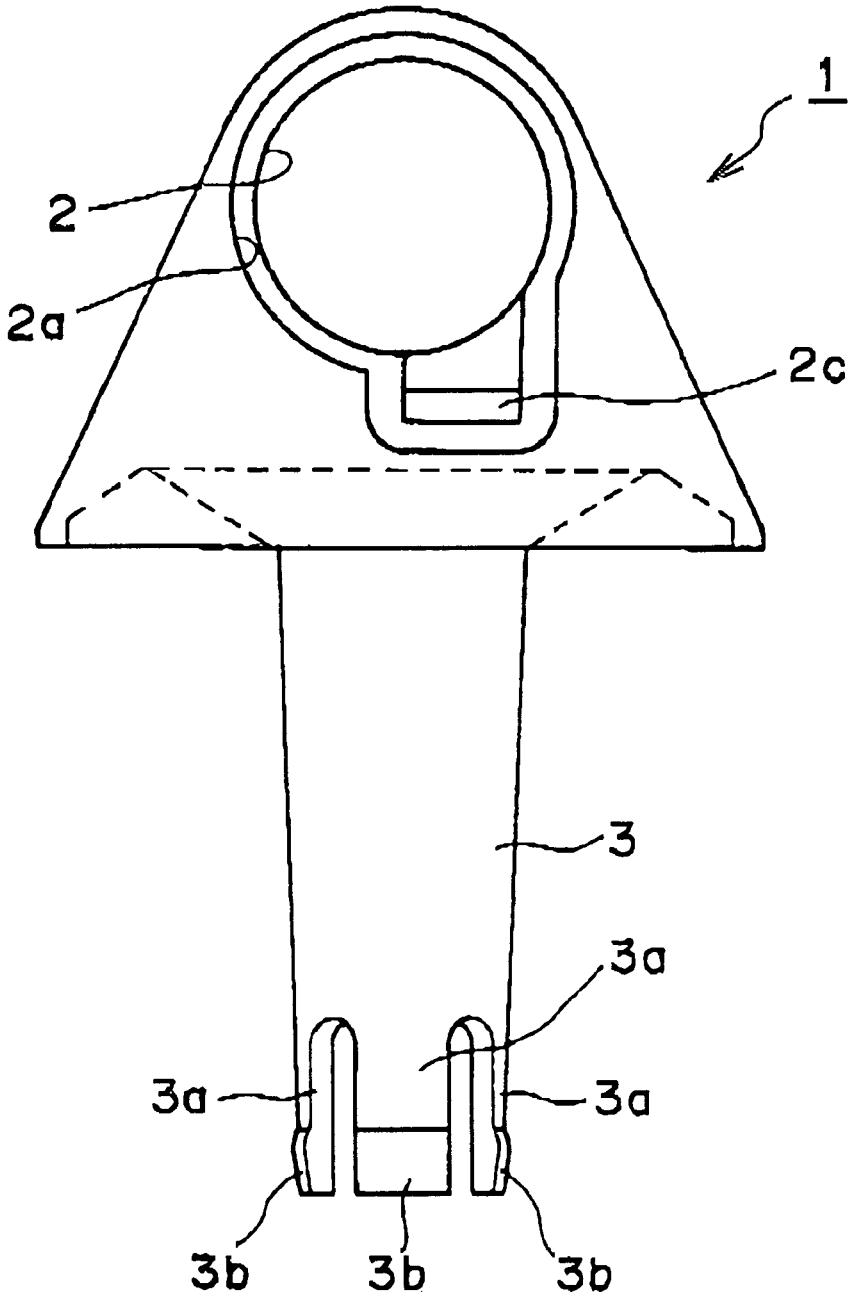
FIG. 1 is a profile of a holder for use with an opening/closing device for seats and lids of Western-styled lavatory stools according to the invention.
Figure 2:
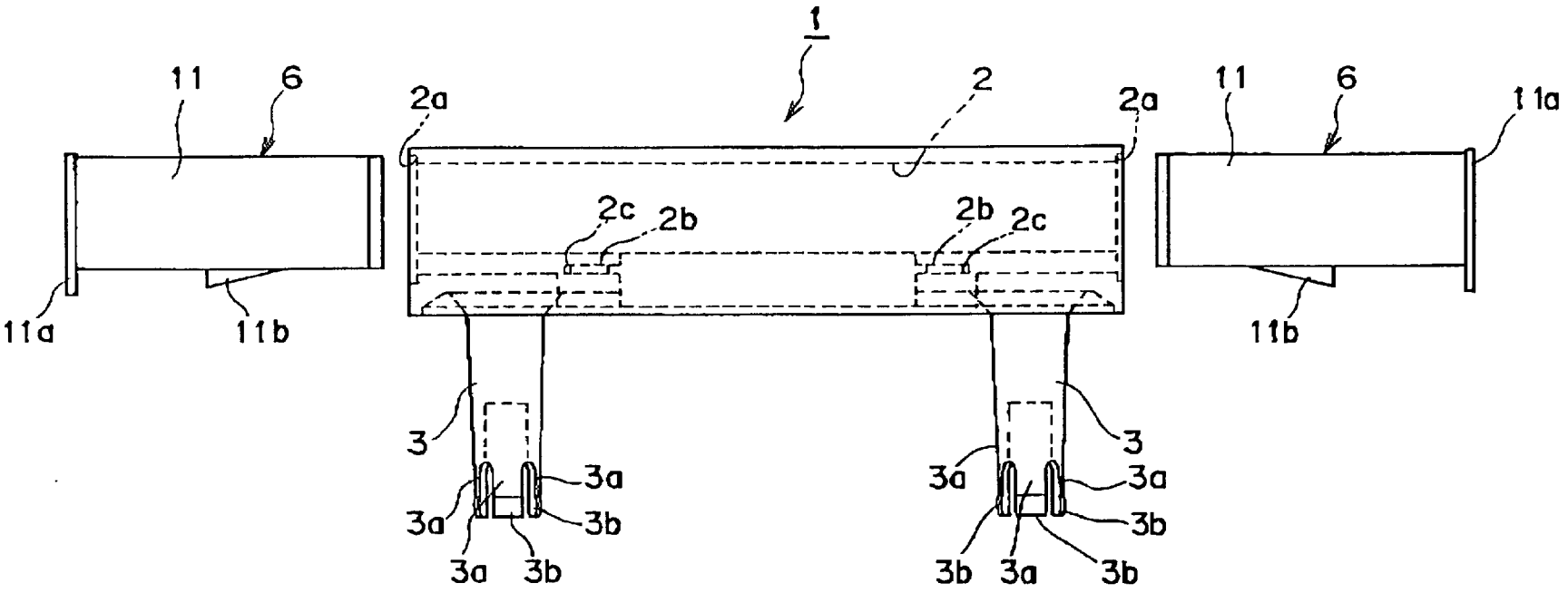
FIG. 2 is an exploded front view of a part of the holder for use with an opening/closing device for seats and lids of Western-styled lavatory stools according to the invention.

The drawings illustrate a preferred embodiment of the present invention, and in FIGS. 1 and 2 in particular, reference numeral 1 denotes a case having a containing hole 2 into which opening/closing devices 6 are to be inserted and fixed, while a pair of legs 3 hang down from two sides of this case 1. Incidentally, although the containing hole 2 in this embodiments penetrates the case, it need not penetrate.

At both ends of the containing hole 2 are provided engaging concave parts 2*a* differently shaped from the containing hole 2, and the inner bottom of the hole 2 has elastic engaging pieces 2*c* having engaging holes 2*b*. The legs 3 are cylindrically shaped toward their lower end, and provided with four elastic engaging pieces 3*a* by dividing the cylindrical part into four parts, each of the engaging pieces 3*a* having a projection 3*b* at the tip.

Figure 3:
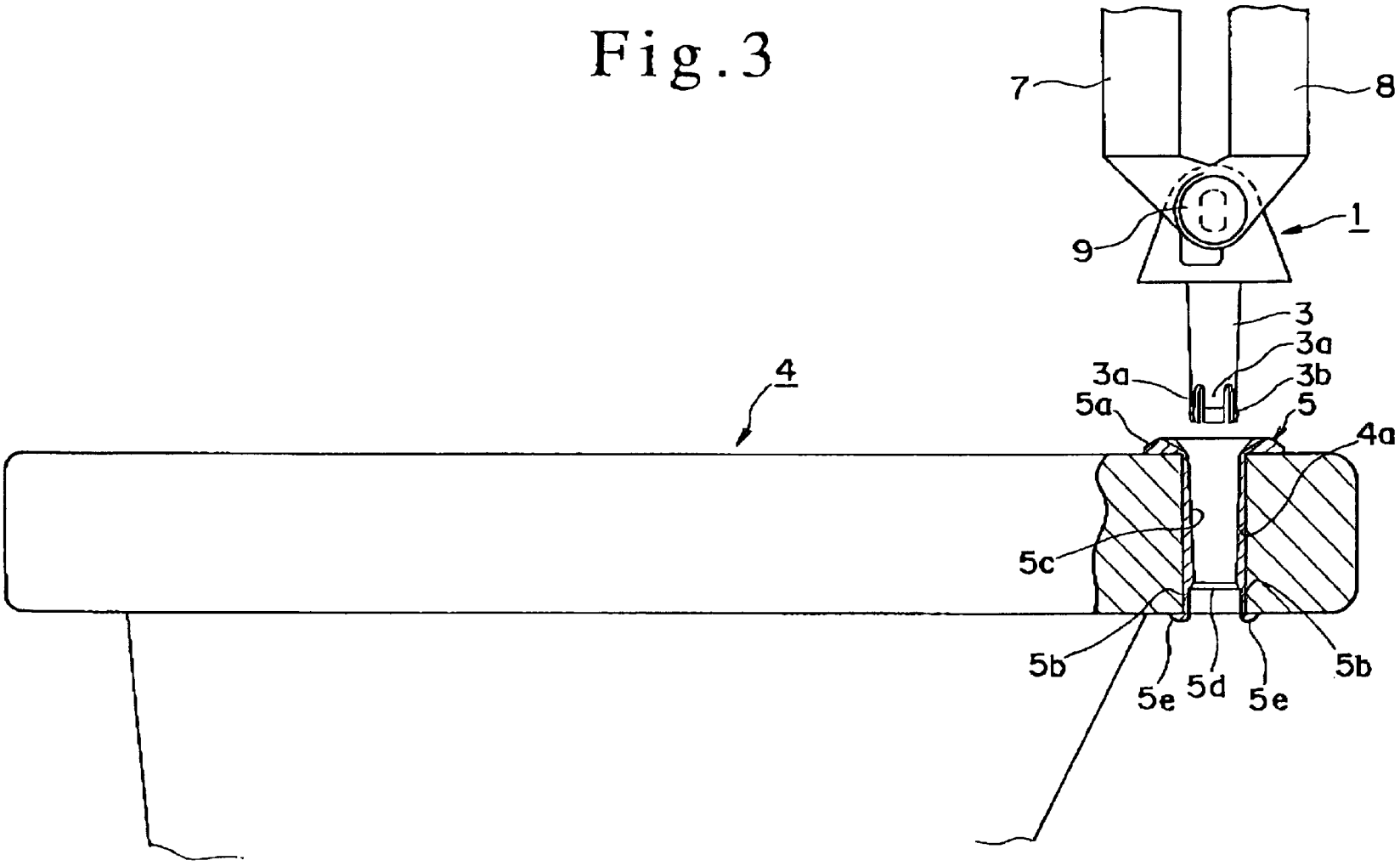
FIG. 3 is a diagram illustrating the function of the holder for use with a paired opening/closing devices for seats and lids of Western-styled lavatory stools according to the invention.
Figure 4:
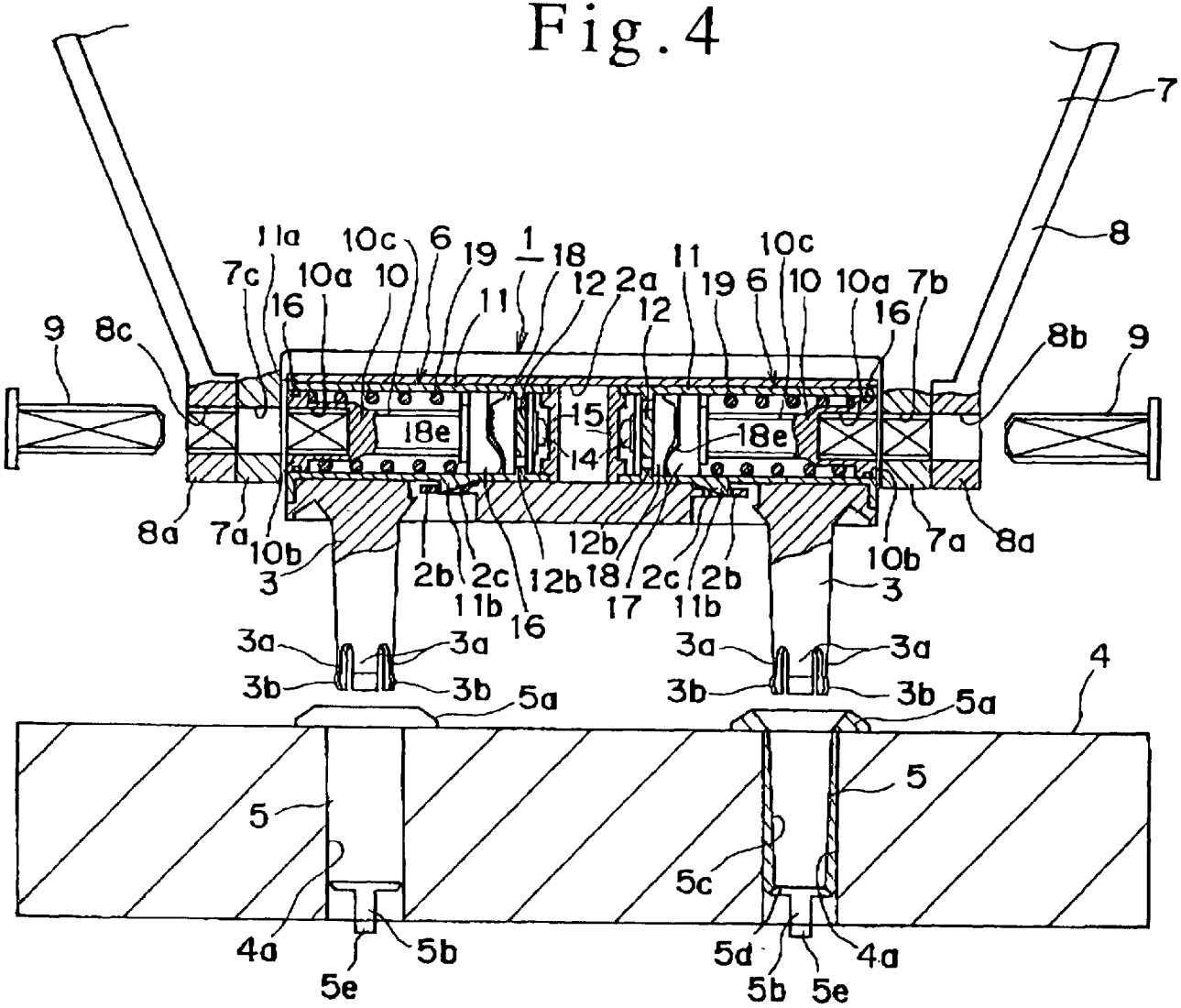
FIG. 4 is a diagram illustrating the holder for use with an opening/closing device for seats and lids of Western-styled lavatory stools according to the invention and an opening/closing device fitted to this holder.

Especially, as shown in FIGS. 3 and 4, a pair of fitting holes 4*a* have elastic engaging members 5*b*, each provided with a flange 5*a*, and holder receptacles 5 having bottomless penetrating holes 5*c* are inserted into and engaged in these holes 4*a* by a snap-fit. Into these holder receptacles 5 are inserted the legs 3 of the case 1 to engage them. In further detail, the legs 3 and the penetrating holes 5*c* are tapered, and the projections 3*b* of the engaging pieces 3*a* of the legs 3 inserted into the penetrating holes 5*c* of the holders 5 are engaged with stepped parts 5*d* provided in the penetrating holes 5*c* of the holder receptacles 5. Engaging projections 5*e* provided at the tip of the engaging members 5*b* are engaged at the lower end of the fitting holes 4*a*.

From the two ends of the containing hole 2 provided in the case 1 are inserted, shown in particular in FIG. 2, cylindrical bodies 11 of the opening/closing devices 6. The case bodies 11 are engaged with the case 1, prevented from rotating and readily coming off by fitting their flanges 11*a* with the engaging concave parts 2*a* and, as shown in particular in FIG. 4, engaging their engaging projections 11*b* with the engaging holes 2*b* of the engaging pieces 2*c*.

Particularly as shown in FIG. 4, fitting holes 7*b*, 7*c*, 8*b* and 8*c*, provided in the fitting parts 7*a* and 8*a*, respectively or a lavatory seat 7 and a lavatory lid 8 are applied to deformed holes 10*a* provided in rotating shafts 10 of the opening/closing devices 6, and the fitting parts 7*a* and 8*a* of the seat 7 and the lid 8, respectively, are linked to the opening/closing devices 6 with fitting pins 9 in a manner allowing the seat 7 and the lid 8 to be freely opened or closed. To describe this arrangement in further detail, the external shape of the fitting pins 9 constitute deformed axial parts matching the deformed holes 10*a* of the rotating shafts 10, and the fitting pins 9 are so disposed as to rotate together with the rotating shafts 10 of the opening/closing devices 6.

On the other hand, while one each of the fitting holes 7*b*, 7*c*, 8*b* and 8*c* provided in the fitting parts 7*a* and 8*a*, respectively, of the seat 7 and the lid 8 has a circular cross section, the other has a deformed shape matching the fitting pins 9. In this embodiment, the fitting holes 7*b* and 8*c* are deformed in shape while the fitting holes 7*c* and 8*b* have a circular cross section. Therefore, when the seat 7 is opened or closed, the opening/closing device on the right side of FIG. 4 operates, but that on the left side does not, only supporting this seat 7 via its fitting pin 9. Then, when the lid 8 is opened or closed, the opening/closing device on the left side of FIG. 4 operates, but that on the right side does not, only supporting this seat 7 via its fitting pin 9.

In this manner, the opening/closing devices 6 operate alternately in the opening/closing of the seat 7 or the lid 8, only one at a time.

Particularly as shown in FIGS. 3 and 4, as the fitting parts 7*a* and 8*a* of the seat 7 and the lid 8, respectively, are linked to the rotating shafts 10 of the opening/closing devices 6 contained and fixed in the containing holes 2 of the case 1 with the fitting pins 9, and then the rear parts of the seat 7 and the lid 8, held together by both hands together with the case 1, are applied to inlets of the holder receptacles 5 and pressed downward, the projections 3*b* of the engaging pieces of the legs 3 are engaged with the stepped parts 5*d* of the holder receptacles 5, and the opening/closing devices 6 are fitted, together with the seat 7 and the lid 8, firmly to the lavatory stool 4.

Next will be described the internal structure of the opening/closing devices 6. As illustrated in FIG. 4, they are symmetrical around the vertical axis, and substantially the same in structure, though different in details, such as the specific shape of the cam and the elasticity of the spring because of the difference in weight between the seat 7 and the lid 8. This also means that opening/closing devices to be fitted to the holder according to the present invention are not limited to the embodiment described here. It is possible to fit opening/closing devices of greatly diverse structures to the holder according to the invention.

Figure 5:
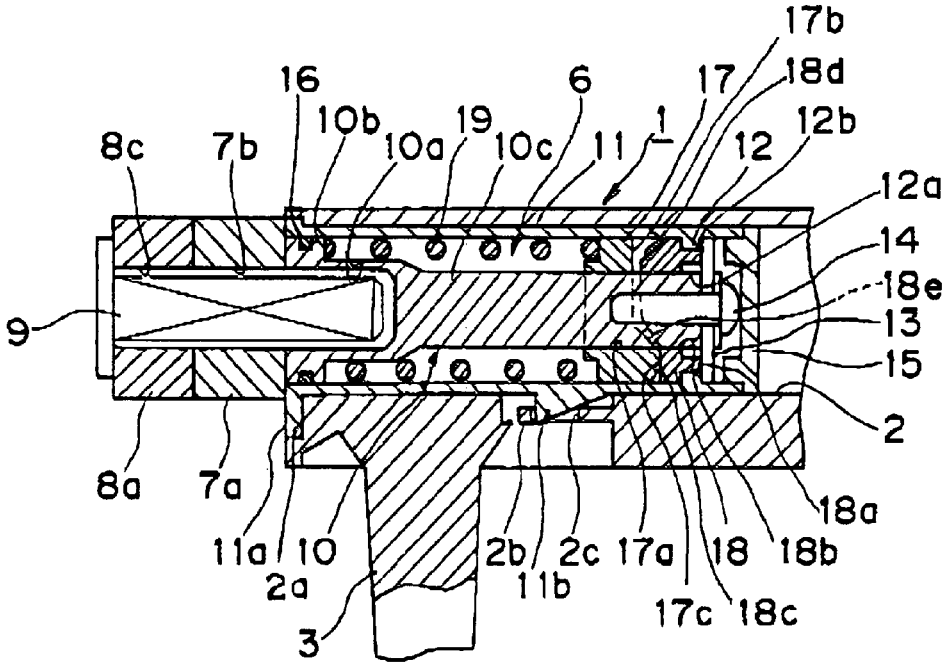
FIG. 5 is an expanded cross section of further internal details of the holder for use with an opening/closing device for seats and lids of Western-styled lavatory stools according to the invention and the other of the paired opening/closing devices fitted to the holder.
Figure 6:
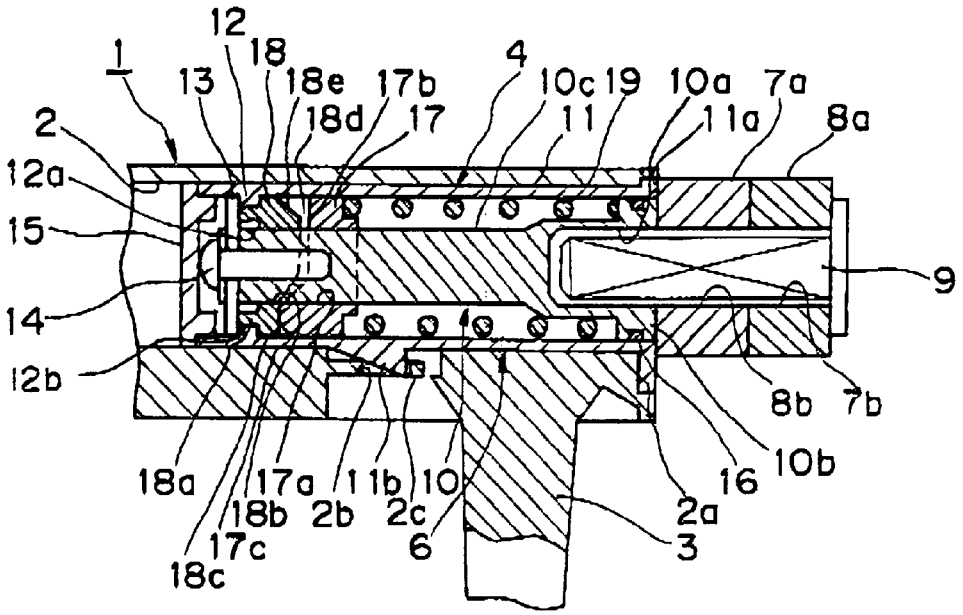
FIG. 6 is an expanded cross section of further internal details of the holder for use with an opening/closing device for seats and lids of Western-styled lavatory stools according to the invention and one of the paired opening/closing devices fitted to the holder.

Referring to FIGS. 5 and 6 in particular, the rotating shaft 10 has a large-diameter part 10*b*, provided at its one end, borne within the case body 11, its other end borne in a bearing hole 12*a* provided in a partitioning 12 provided within the case body 11, and a stopper washer 13 is fastened with a fitting screw 14, thereby preventing the shaft 10 from coming off in the axial direction. Incidentally, reference numerals 15 and 16 respectively denote a lid and an O ring. The rotating shaft 10 has a small-diameter deformed axial part 10*c* following the large-diameter part 10*b*, and a sliding cam 17, allowing this deformed axial part 10*c* penetrate its deformed hole 17*a*, is fitted to be able to slide in the axial direction and to rotate together with the rotating shaft 10. Between this sliding cam 17 and the large-diameter part 10*b* is elastically installed a compression spring 19, wound around the deformed axial part 10*c*, to press the sliding cam 17 so as to cause it to slide always in a single direction.

In a position opposite to this sliding cam 17 is provided a fixed cam 18, letting the rotating shaft 17 penetrate a penetrating hole 18*b* bored in its center, by inserting and engaging a plurality of projections 18*a* in a plurality of fixing holes 12*b* provided in the partitioning 12, and the sliding cam 17 is always given force by the compression spring 19 in the direction of being pressed against this fixed cam 18. The sliding cam 17 is provided with concave parts 17*b* and convex parts 17*c* at 180° intervals, and the fixed cam 18 has a pair each of concave parts 18*c* and convex parts 18*d* in the positions opposite to these convex parts 17*c*.

Therefore, when the seat 7 and the lid 8 are on the lavatory stool 4 and their opening angles are 0°, the convex parts 17*c* of the sliding cam 17 are in contact with the convex parts 18*d* of the fixed cam 18, and the compression spring 19 is compressed to the maximum, but when these seat 7 and lid 8 are opened, the convex parts 17*c* of the sliding cam 17 drop from the convex parts 18*d* of the fixed cam 18 along sloped parts 18*e* into the concave parts 18*c*, so that the seat 7 and the lid 8 can be opened with relative ease, stopping and being stably held at an opening angle of 90° or more.

When the seat 7 and/or the lid 8 are to be closed, the convex parts 17*c* of the sliding cam 17 climb the sloped parts 18*e* from the concave parts 18*c* of the fixed cam 18 against the elastic force of the compression spring 19, making it possible to prevent the seat 7 and the lid 8 from dropping abruptly.

What is claimed is:

1. A holder for use with an opening/closing device for seats and lids of Western-styled lavatory stools comprising:

a cylindrical case open at both ends, structured so as to allow insertion and engagement of a pair of opening/closing devices, of which one works on the seat and the other on the lid, with one inserted from one of the two ends of the case and the other from the other end in a detachable manner;

a pair of legs hanging from this case each having at its lower end an engaging piece given elasticity; and holder receptacles structured to be snap-fitted into fitting holes provided in the lavatory stool to allow detachable insertion and engagement of the pair of legs as well in a freely detachable manner.

2. A holder for use with an opening/closing device for seats and lids of Western-styled lavatory stools comprising:

a cylindrical case open at both ends, structured so as to allow insertion and engagement of a pair of opening/closing devices, of which one works on the seat and the other on the lid, with one inserted from one of the two ends of the case and the other from the other end in a detachable manner;

a pair of legs hanging from this case each having at its lower end an engaging piece given elasticity; and holder receptacles structured to be snap-fitted into holes provided in the lavatory stool to allow detachable insertion and engagement of the pair of legs as well in a freely detachable manner, wherein:

said holder receptacles are composed in a bottomless cylindrical form having engaging projects at their lower end so that they can be contained and fixed in penetrating holes bored into the stool itself.

* * * * *